US007346172B1

(12) United States Patent
Begault

(10) Patent No.: US 7,346,172 B1
(45) Date of Patent: Mar. 18, 2008

(54) AUDITORY ALERT SYSTEMS WITH ENHANCED DETECTABILITY

(75) Inventor: Durand R. Begault, San Francisco, CA (US)

(73) Assignee: The United States of America as represented by the United States National Aeronautics and Space Administration, Washington, DC (US)

( * ) Notice: Subject to any disclaimer, the term of this patent is extended or adjusted under 35 U.S.C. 154(b) by 970 days.

(21) Appl. No.: 09/822,470

(22) Filed: Mar. 28, 2001

(51) Int. Cl.

| | |
|---|---|
| ***H04R 29/00*** | (2006.01) |
| ***H04R 5/00*** | (2006.01) |
| ***H04R 5/02*** | (2006.01) |
| ***G08B 3/10*** | (2006.01) |
| ***G08B 19/00*** | (2006.01) |

(52) U.S. Cl. ..... 381/56; 381/1; 381/17; 381/309; 381/310; 381/58; 340/384.5; 340/521

(58) Field of Classification Search ..... 381/1, 381/17, 309, 310, 56, 58; 340/384.5, 521
See application file for complete search history.

(56) References Cited

U.S. PATENT DOCUMENTS

| | | | | |
|---|---|---|---|---|
| 4,644,327 | A | 2/1987 | Patterson | |
| 4,768,022 | A | 8/1988 | Patterson | |
| 4,802,225 | A | 1/1989 | Patterson | |
| 5,422,977 | A | 6/1995 | Patterson | |
| 5,987,142 | A * | 11/1999 | Courneau et al. | 381/17 |
| 6,125,115 | A * | 9/2000 | Smits | 370/389 |
| 6,647,119 | B1 * | 11/2003 | Slezak | 381/17 |

OTHER PUBLICATIONS

J.F. Culling and H.S. Colbourn. Journal of Acoust. Soc. Americal, vol. 107, Jan. 2000, pp. 517-527.*
ISO Standard 7731. Danger signals for work places—Auditory danger signals. 1986.*
ISO Standard 5129. Acoustics-Measurements of noise inside aircraft. 1981.*
ISO Standard 8201. Acoustics-Audible emergency evacuation signal. 1987.*

(Continued)

*Primary Examiner*—Vivian Chin
*Assistant Examiner*—Devona E Faulk
(74) *Attorney, Agent, or Firm*—John F. Schipper; Robert M. Padilla

(57) ABSTRACT

Methods and systems for distinguishing an auditory alert signal from a background of one or more non-alert signals. In a first embodiment, a prefix signal, associated with an existing alert signal, is provided that has a signal component in each of three or more selected frequency ranges, with each signal component in each of three or more selected level at least 3-10 dB above an estimated background (non-alert) level in that frequency range. The alert signal may be chirped within one or more frequency bands. In another embodiment, an alert signal moves, continuously or discontinuously, from one location to another over a short time interval, introducing a perceived spatial modulation or jitter. In another embodiment, a weighted sum of background signals adjacent to each ear is formed, and the weighted sum is delivered to each ear as a uniform background; a distinguishable alert signal is presented on top of this weighted sum signal at one ear, or distinguishable first and second alert signals are presented at two ears of a subject.

14 Claims, 6 Drawing Sheets

OTHER PUBLICATIONS

H. Fletcher, Rev. Mod. Phys. vol. 12 (1940) pp. 47-65.
K. Zwicker, Jour..Acoust. Soc. Amer., vol. 33 (1961), p. 248.
D. R. Begault, "3-D Sound for Virtual Reality and Multimedia", NASA/TM-2000-209606 (Aug. 2000), pp. 31-67.
D.W. Grantham and F.L. Wightman, Jour. Acoust. Soc. Amer., vol. 65 (1979) pp. 1509-1517.
D.W. Grantham, "Spatial" Hearing and Related Phenomena, (in) B.C.J. Moore, *Hearing*, Academic Press, 1995, pp. 297-345.
J.F. Cutting and H.S. Colburn, Jour. Acoust. Soc. Amer., vol. 107 (2000) pp. 517-527.
ISO Standard 5129 (1981) "Acoustics—Measurement of noise inside aricraft".
ISO Standard 7731 (1986) "Danger signals for work places-Auditory danger signals".
ISO Standard 8201 (1987) "Acoustics-Audible emergency evacuation signal".

* cited by examiner

AUDITORY ALERT SYSTEMS WITH ENHANCED DETECTABILITY

FIELD OF THE INVENTION

This invention relates to auditory alert systems for use in the presence of background sounds.

BACKGROUND OF THE INVENTION

Auditory warning systems for human interfaces are often designed around criteria that depend primarily upon signal loudness. It is well understood from the auditory literature that, by making an alert signal substantially louder than the measured background noise level, one can insure that an alert signal will be detectable. For example, an ISO standard 7731 ("Danger signals for work places—Auditory danger signals", ISO Standard 7731-1986(E)) specifies that an auditory alert signal be issued with frequency components at a sound pressure level at least 13 dB above an average level of all background sounds. This approach to detection is referred to as "exceeding the masked threshold"; the spectral components of the alert signal have sufficient amplitude so that these components can be heard. As used herein, "noise" refers to non-information-bearing auditory signals, and "background sound" includes noise and information-bearing auditory signals whose content is not of interest for the task at hand (e.g., for purposes of distinguishing presence of an auditory alert signal). Usually, but not always, the noise level or background sound level has been time averaged over a time interval of appropriate length.

For a typical design of an auditory alert system, the overall amplitude or sound pressure level is often set at a value substantially greater than the background sound level. This approach is simple to understand and to implement. However, if an alert signal sound pressure level is too loud, the alert signal may produce a "startle effect" that hinders performance in some high stress situations. High amplitude alarms have been used in the past because (1) most communication equipment was of limited audio fidelity and (2) loudspeakers, located at a substantial distance form the subject, or monaural (single ear) auditory signal systems, were used for such communications.

What is needed is an alternative approach that uses other features, such as frequency component processing and/or spatial modulation of signals, to improve the detectability of an alert signal, without substantially increasing the amplitude level of an alert signal beyond the background sound level. The approach should preferably be able to combine acoustical features, other than amplitude, to provide greater improvements in alert signal detectability. Ideally, but not necessarily, an alert signal is delivered to a subject through two stereo earphones.

SUMMARY OF THE INVENTION

These needs are met by the invention, which provides several different but compatible approaches to enhance the detectability of an alert signal. Binaural communication, using two transducer channels (e.g., stereo earphones or loudspeakers) with independent signal delivery systems, is preferred. In a first approach, an existing auditory alert signal is supplemented with a brief burst of selected spectral components, chosen to exceed an auditory masking threshold and lying in a broader frequency bandwidth, 0.1-10 KHz, than the frequency bandwidth of the alert signal, delivered at a level that is at least M dB above a general background of auditory signals including noise, where M is a relatively small positive number, such as 3-10. An alert prefix signal, preceding or contemporaneous with an alert signal, is issued that has one or more selected tones within each of several critical frequency bands, at a prefix signal level at least M dB above the background; and alert signal detectability is thereby increased.

A second approach uses spatial modulation in a binaural signal delivery system (e.g., a pair of stereo earphones worn by a subject) to make a signal appear, to the subject, to move from one location to another within a selected time interval. For example, by varying the relative time delay and/or sound intensity difference of a signal received at the subject's two ears, the signal's apparent location may be moved from 0-120° azimuthal angle to the right to 0-120° azimuthal angle to the left, and back again, over a selected time interval. Most subjects can more easily distinguish apparent or virtual motion of a signal source from a generally static background sound, as compared to a signal source with a static source location. For steady state background noise, which is relatively unvarying in its spatial properties, a spatially modulated (jittered) alarm is more detectable than is one that is not spatially modulated.

Many methods can be used to implement spatial modulation, including linear amplitude panning and exponential amplitude panning. Continuously varying a signal time delay at each ear in a range 0-0.8 msec can accomplish a similar effect. Binaural variations of frequency in time and amplitude can be implemented using a three-dimensional sound interface that allows movement of a virtual source relative to a listener.

In a third approach, a microphone or other sound transducer provides a sound level that would otherwise be present at each of the subject's ears, averages these signals, and delivers the averaged signal to each ear through a pair of stereo earphones, as a more or less homogeneous background signal that the subject's ears interpret as being present in the "center" of the subject's head. A binaurally differentiated signal, such as the spatially modulated, spectrally altered alert signal discussed in the preceding, is then more easily distinguished from this coherent background signal, because the differentiated signal has low coherence relative to the background signal.

DESCRIPTION OF BEST MODES OF THE INVENTION

Figure 1:
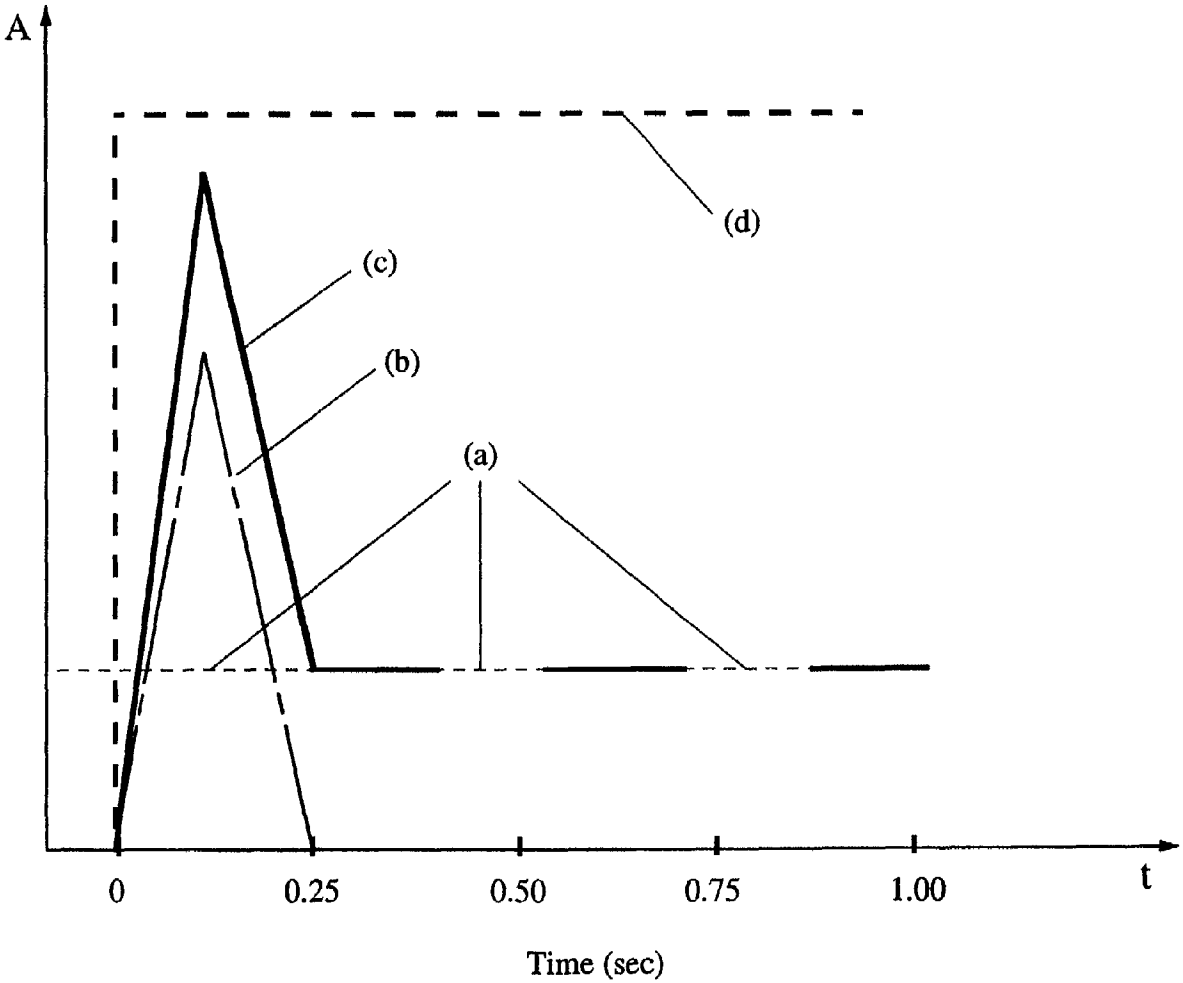
FIG. 1 is a graphical view of signal amplitude envelope versus time for (a) an alert signal, (b) an alert prefix, (c) a sum of (a) and (b), and (d) a signal conforming to ISO 7731.

Design of an auditory alert signal has traditionally relied on a criterion that depends primarily upon signal amplitude. ISO Standards 7731 and 8201 cover the use of an auditory alert signal as a danger signal and suggest that frequency components should be at least 13 dB above the masked threshold level, within one-third octave bands and in a frequency range from 300 to 3000 Hz. Most human subjects have a maximum sensitivity in or near a frequency range 1000-2000 Hz, in the middle of the frequency range for common speech, which is approximately 100-8000 Hz. The invention disclosed here uses criteria that depend primarily upon features other than amplitude to enhance the detectability of an alert signal.

Fletcher, in "Auditory patterns", Rev. Mod. Phys., vol. 12 (1940) pp. 47-65, and Zwicker, in "Subdivision of the Audible Frequency Range into Critical Bands", Jour. Acoustical Soc. of Amer., vol. 33 (1961) p. 248, have noted the existence of a filtering process for the auditory system that analyzes a signal into frequency ranges, referred to as "critical bands.". In a simplified explanation of critical bands, the ear receives and processes a complex sound through about 24 bandpass filters, each filter being centered at a critical band center frequency and having a bandwidth of approximately one-third octave. Two signal components lying in different critical bands will interact minimally, and each of these signal components can be distinguished by a human's auditory system. These results suggest that the ear processes a complex sound substantially independently within each critical band. Table 1 sets forth 24 of the critical band frequencies identified by Zwicker. The frequencies of primary interest here range from about 100 Hz (lower end of band no. 2) to about 9400 Hz (upper end of band no. 22), although the invention extends to all critical bands.

TABLE 1

Critical Frequency Bands

| Critical band number | Center frequency | Band width |
|---|---|---|
| 01 | 50 Hz | 60 Hz |
| 02 | 150 | 100 |
| 03 | 250 | 100 |
| 04 | 350 | 100 |
| 05 | 450 | 110 |
| 06 | 570 | 120 |
| 07 | 700 | 140 |
| 08 | 840 | 150 |
| 09 | 1000 | 160 |
| 10 | 1170 | 190 |
| 11 | 1370 | 210 |
| 12 | 1600 | 240 |
| 13 | 1850 | 280 |
| 14 | 2150 | 320 |
| 15 | 2500 | 380 |
| 16 | 2900 | 480 |
| 17 | 3400 | 550 |
| 18 | 4000 | 700 |
| 19 | 4800 | 900 |
| 20 | 5800 | 1100 |
| 21 | 7000 | 1300 |
| 22 | 8500 | 1800 |
| 23 | 10500 | 2500 |
| 24 | 13500 | 3500 |

The critical bands of frequencies in Table 1 have been found to be especially important in distinguishing spectral components in an information-bearing ("IB") signal from noise. According to the definitions adopted in the preceding, even a background signal may contain information, but if this information is not of interest in the task at hand (detection of presence of an auditory alert signal), the background sound (including noise) is to be distinguished from the alert signal. When both an alert signal and a background sound signal are present in a single critical band, the average human ear is markedly less effective in distinguishing the two signals from each other than where the alert signal and the background sound signal are contained in different critical bands. According to this invention, one can analyze signals using one-third octave bands, critical bands, or any other psychoacoustic or engineering measure of loudness.

In a first embodiment of the invention, an alert signal is preceded by, or supplemented at its onset with, an associated, brief alert prefix signal that covers several of these critical bands, at a signal level at least M dB higher than the background level in each band. Detection of presence of the alert signal is substantially enhanced if, within each of a selected number N of the critical bands ($2 \leqq N \leqq 24$), the signal level for the alert signal or alert prefix signal is at least M=3-10 dB above the background sound level in that band. With this approach adopted, detection of presence of the alert signal is enhanced, relative to a simple harmonic alert signal component. Inclusion of additional spectral components from the alert signal appears to (re)trigger a subject's hearing system and to allow a release from masking. One advantage of combining an existing alert signal with an alert prefix signal, having spectral components with appropriate amplitudes in several critical bands, is that the alert signal is still recognized as such by the subject, if the prefix signal is brief relative to the alert signal. Preferably, the alert prefix signal has a duration in a range 25 msec $\leqq \Delta t \leqq$ 500 msec, and preferably 25 msec $\leqq \Delta t \leqq$ 200 msec, but may be longer in some instances.

The background sound level at the subject's ear(s) is estimated, by measurement or by some empirical approach, within one or more selected critical bands, and the summed or integrated background sound level within each such band determines the minimum alert signal amplitude to be used in that band. ISO Standard procedure 5129 ("Acoustics-Measurement of noise inside aircraft", 1981, 1987) may be followed to measure background sound level or noise level within an aircraft. A fast rise-fast decay amplitude within a 200 msec time interval is preferred for a critical band burst, with the sound amplitude being reduced by at least 12 dB below its peak value within the first 50 msec. FIG. 1 graphically presents amplitude envelopes of (a) a conventional alert signal, (b) an alert prefix signal that would qualify under these criteria, (c) the sum of the signals (a) and (b), and (d) a signal conforming to ISO 7731 standards (at least 13 dB above the background sound level).

Figure 2A:
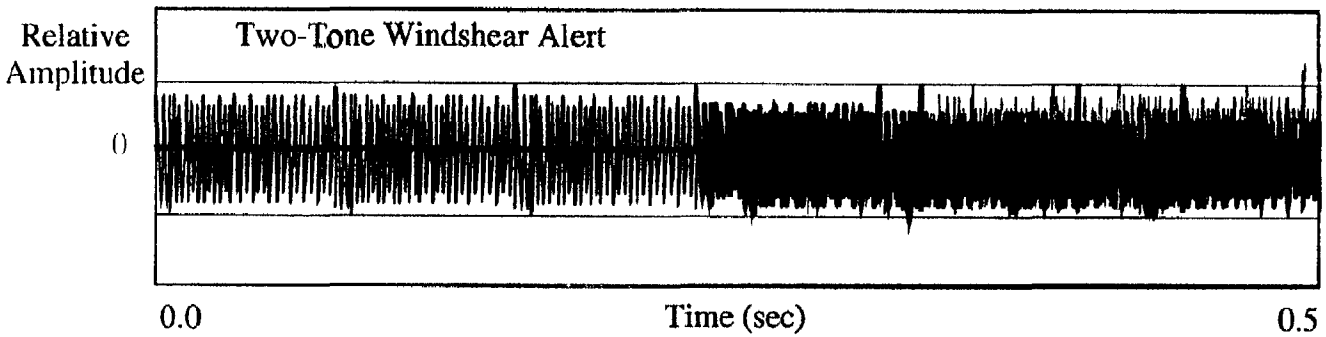
FIGS. 2A and 2B are graphical views illustrating a two-tone alert signal.
Figure 2B:
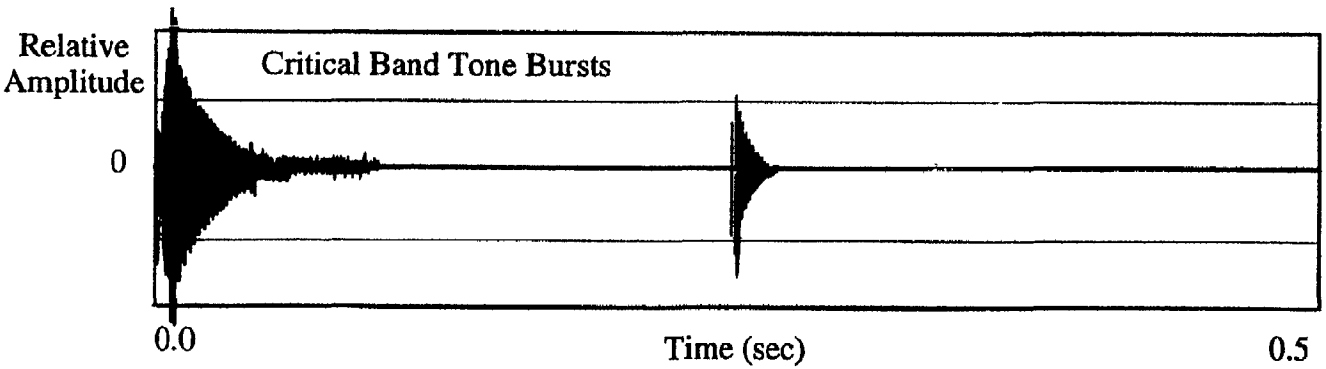

FIGS. 2A and 2B are graphical views of a two-tone audible warning presently used for wind shear alert and a suitable critical band tone burst according to the invention, respectively.

Figure 3:
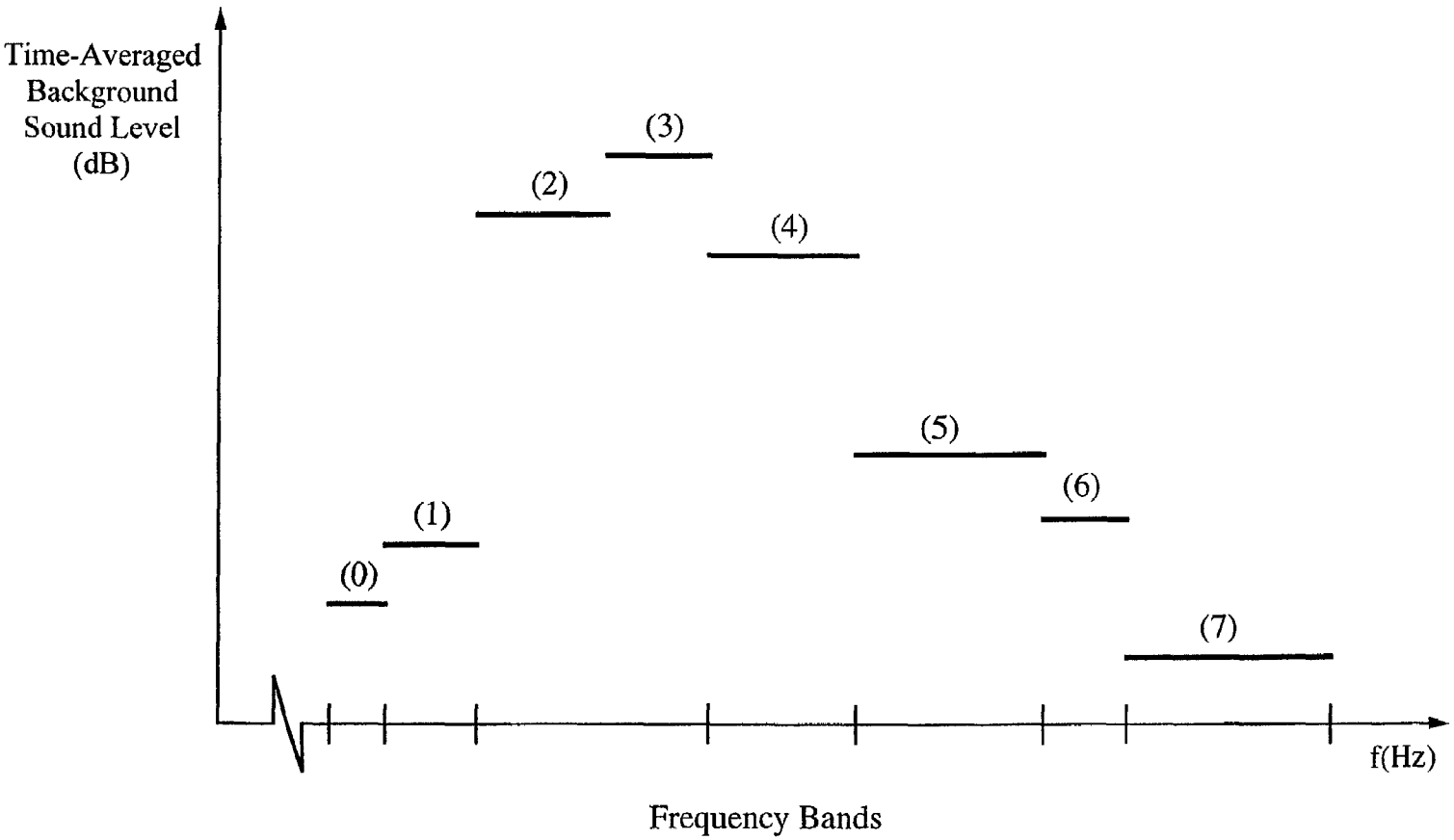
FIGS. 3 and 4 are graphical views illustrating variations on a first embodiment of the invention.

The time-averaged or other background sound level, including but not limited to noise, may be measured in one or more (preferably all) critical bands, or one-third octave bands, of frequencies and provided in numerical or graphical form. The square of the background sound spectrum B(f), a (non-negative) system transducer sensitivity T(f) and a (non-negative) sensitivity S(f) of the subject's ear(s) are multiplied together and integrated over all frequencies f within a critical band or other chosen range of frequencies ($f_{1,cr} \leqq f \leqq f_{2,cr}$) to provide an rms background sound value $BSV(f_{1,cr};f_{2,cr};2)$ that characterizes the frequency range $f_{1,cr} \leqq f \leqq f_{2,cr}$. An example of this process is $$BSV(f_{1,cr};f_{2,cr};2)=\{\int |B(f)|^2 \cdot T(f) \cdot S(f) df\}^{1/2}, \quad (1)$$

where the integration is performed over the chosen frequency range. The ear sensitivity function S(f) varies with the subject but rises from a small, positive value in a range f=20-100 Hz to a broad maximum in a range f=1,000-2,000 Hz and decreases for frequencies above f=6,000 Hz. A graphical plot of the background sound value BSV within each frequency range may be as illustrated in FIG. 3. More generally, a kth moment BSV, defined by $$BSV(f_{1,cr};f_{2,cr};k)=\{\int|B(f)|^k\cdot T(f)\cdot S(f)df\}^{1/k}, \quad (2)$$

may be computed, where k is a selected positive real number. As the moment number k is increased, the kth moment background sound value $BSV(f_{1,cr};f_{2,cr};k)$ will increasingly emphasize the peak values of the background sound spectrum B(f) within the chosen range.

The kth moment BSV, set forth in Eqs. (1) and (2), is merely an example of a measure of background sound value that can be adopted. The integrals in Eqs. (1) and (2) can be replaced by, or supplemented by, summation operations over a sampled set of frequencies within the selected frequency range $f_{1,cr} \leqq f \leqq f_{2,cr}$. The transducer sensitivity T(f) and the sensitivity S(f) of the subject's ear(s) may be continuous, discrete or a combination of continuous and discrete.

An alert signal component within a critical band or other chosen frequency range is then set at a level at least M dB above a level corresponding to $BSV(f_{1,cr};f_{2,cr};k)$ for that band. In a first variation on the first embodiment, two or more critical bands having relatively low associated background sound values, for example, bands 0, 1, 5, 6 and 7 in FIG. 3, are chosen as bands in which an alert signal component is provided. The corresponding alert signal for each chosen critical band may have a sound level that is at least M dB above the background sound level for that band but is below the background sound level for at least one other band, such as the bands 2, 3 and 4 in FIG. 3 where the BSV is much higher.

Figure 4:
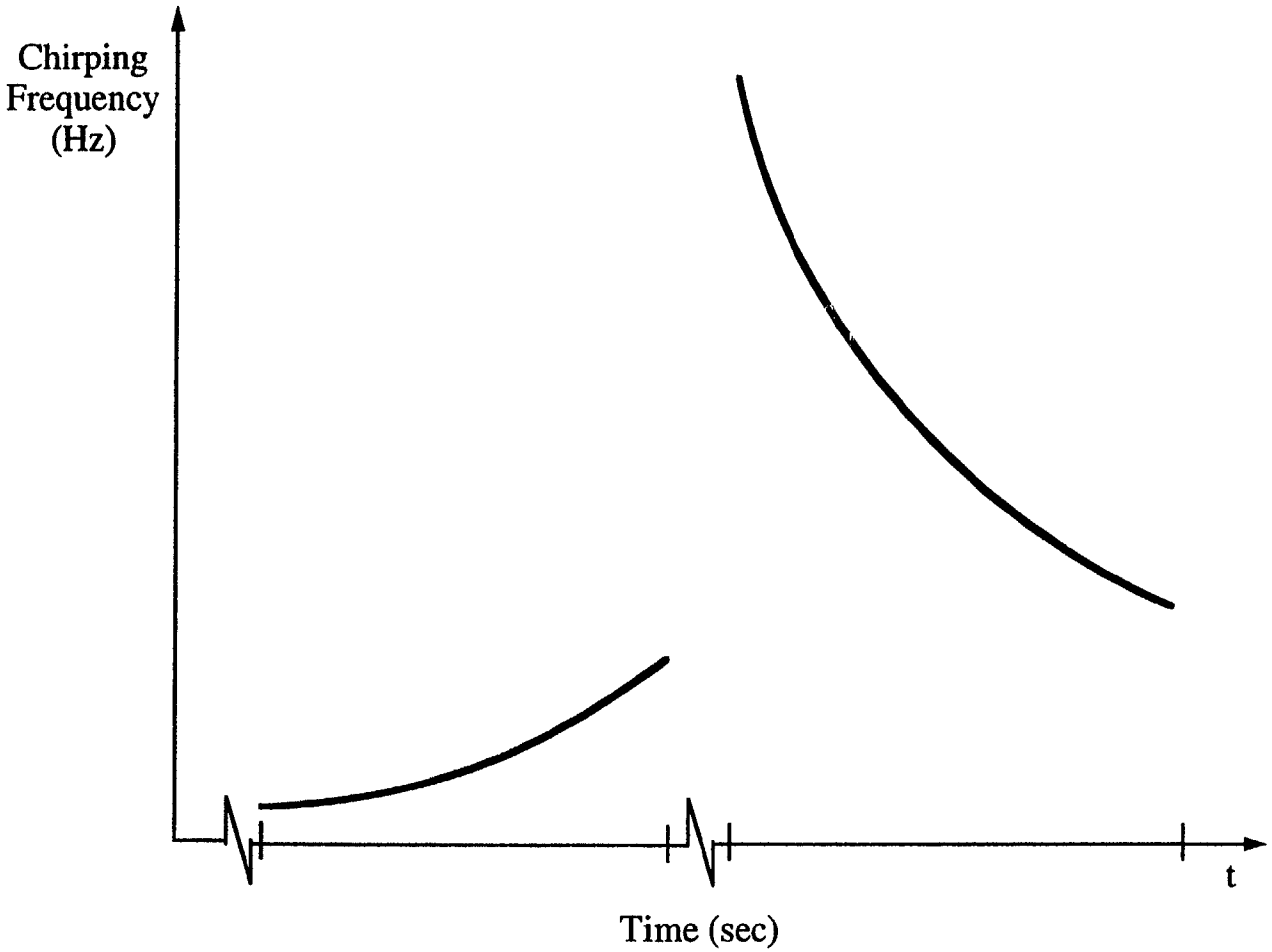

In a second variation on the first embodiment, an alert signal may be provided as a chirped signal (low-to-high or high-to-low frequencies) across two or more critical bands at a level at least M dB above the sound background level within that band, as illustrated in two separate bands in FIG. 4. By providing a chirped alert signal across two or more critical bands which may be but need not be contiguous, the release from masking is more complete, and the early portion of the chirped signal acts as a "wake-up" signal to focus attention on the remaining portion of the alert signal. Where a chirped signal is used, the time duration of this chirped signal is preferably 0.01-1 sec, and more preferably lies in a range 0.05-0.2 sec.

In another embodiment of the invention, the subject receives different alert signal components at each of two stereo earphones, and the alert signal components are spatially modulated to appear as if the source of the received signal is moving in front of (or in back of) the subject. This preferred embodiment uses the time-varying filtering effects of a binaural head-related transfer function pair (one for each ear), which can distinguish different time delays and different intensities associated with a moving signal that arrives at each ear of a subject. Using relative time delay and/or relative signal intensity difference, the alert signal first appears either in front of the subject or to the right front (or left front) of the subject at a first location with a first azimuthal angle $\phi\mathbf{1}$, with $0 \leqq \phi 1 \leqq 120°$, with $15° \leqq \phi 1 \leqq 90°$ preferred, measured in a horizontal plane that contains the subject's ears, from an axis AA that bisects the subject's head. This is discussed in more detail in D. R. Begault, "3-D Sound for Virtual Reality and Multimedia" NASA/TM-2000-209606 (August 2000), pp. 31-67.

The perceived location of the alert signal then moves, continuously or discontinuously, within a first time interval of selected duration $\Delta t\mathbf{1}$, to a second location to the left front (or to the left rear) of the subject at a second azimuthal angle $\phi\mathbf{2}$, with $-120° \leqq \phi 2 \leqq 0$, with $-90° \leqq \phi 2 \leqq -15°$ preferred. Negative and positive azimuthal angles may be interchanged here. The perceived location of the signal source then moves, continuously or discontinuously, within a second time interval of selected duration $\Delta t\mathbf{2}$ to a third location with corresponding azimuthal angle $\phi 3$, which may, but need not, coincide with the first location. "Left" and "right" can be interchanged here. This perceived movement may be characterized as "spatial modulation."

Figure 5:
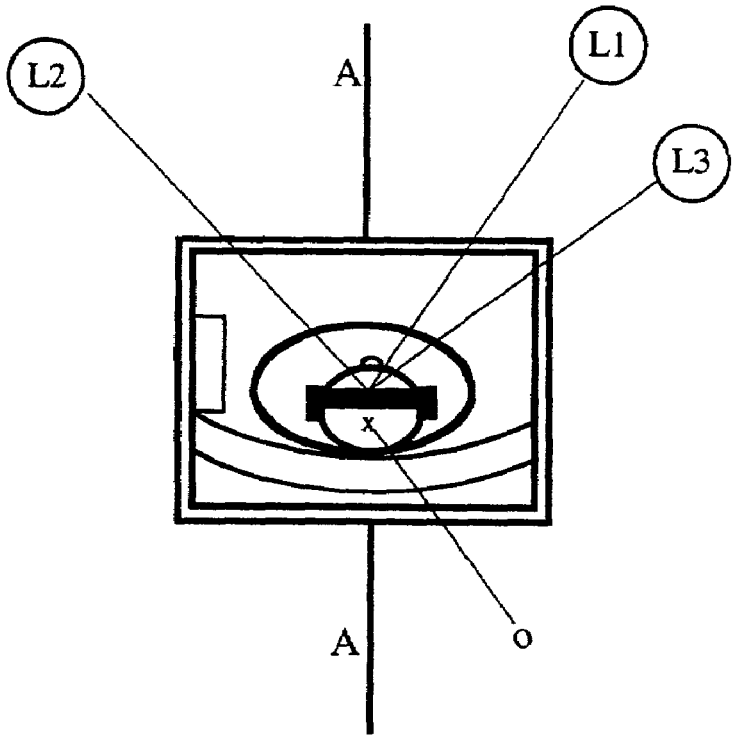
FIGS. 5 and 6 are schematic views of systems used in other embodiments of the invention.

The time interval durations preferably satisfy $0.1 \text{ sec} \leqq \Delta t\mathbf{1} \leqq 0.5$ sec and $0.1 \text{ sec} \leqq \Delta t\mathbf{2} \leqq 0.5$ sec, corresponding to a preferred rate of source location change of 2-10 Hz. The rate of location change is preferably within or near a range of rates that manifests a phenomenon known as "binaural sluggishness", discussed by D. W. Grantham and F. L. Wightman in "Detectability of a pulse tone in the presence of a masker with time-varying interaural correlation", Jour. Acoustical Soc. Amer., vol. 65 (1979) pp. 1509-1917, by D. W. Grantham, "Spatial Hearing and Related Phenomena", in B. J. C. Moore, *Hearing*, Academic Press, San Diego, 1995, pp. 308-310, and by J. F. Cutting and H. S. Colburn, "Binaural sluggishness in the perception of tone sequences and speech in noise", Jour. Acoustical Soc. Amer., vol. 107 (2000) pp. 517-527. This effect occurs when the subject is unable to focus on a present location of the perceived signal. Below approximately 10 Hz, most subjects can perceive change in the signal source location, but cannot perceive a particular location of the source at a given time. In the present invention, the magnitudes of differences of consecutive azimuthal angles are required to satisfy $|\phi(i)-\phi(i+1)| \geqq 15°$ (i=1, 2, . . . ), and more preferably $|\phi(i)-\phi(i+1)| \geqq 30°$. This embodiment is illustrated schematically in FIG. 5. The apparent location may have an arbitrary polar angle, relative to the horizontal plane.

Movement of the peregrinating signal source location, as perceived by the subject, preferably does not allow the subject to focus on any particular location and utilizes the "binaural sluggishness" phenomenon. The subject's attention is stimulated by the auditory system's response to dynamic changes in the inter-aural relationships, as perceived by the subject.

Figure 6:
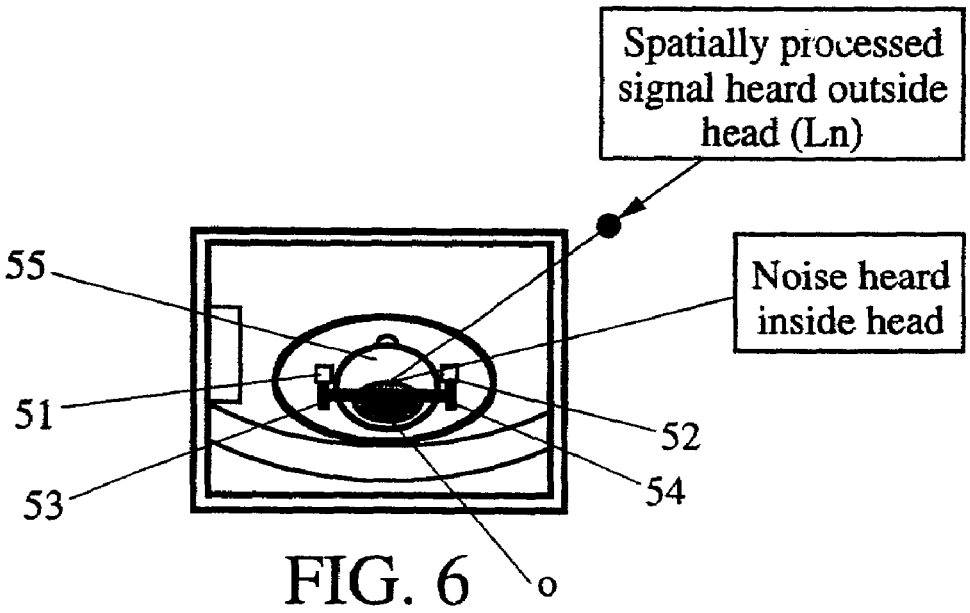

In a third embodiment, illustrated in FIG. 6, sensors or microphones, 51 and 52, located near the left and right stereo earphones, 53 and 54, respectively, of a subject 55, receive background (non-alert) auditory signals. These auditory background signals are weighted according to a selected weighting scheme (including but not limited to equal weighting) and are added together in a signal processor 57 to provide a weighted average signal for each earphone. The weights may be equal or unequal. Ideally, the sound levels for the left and right ear channels are the same, and the combined level for each ear is set to within 1 dB of the average of the background levels at the two ears.

Figure 7:
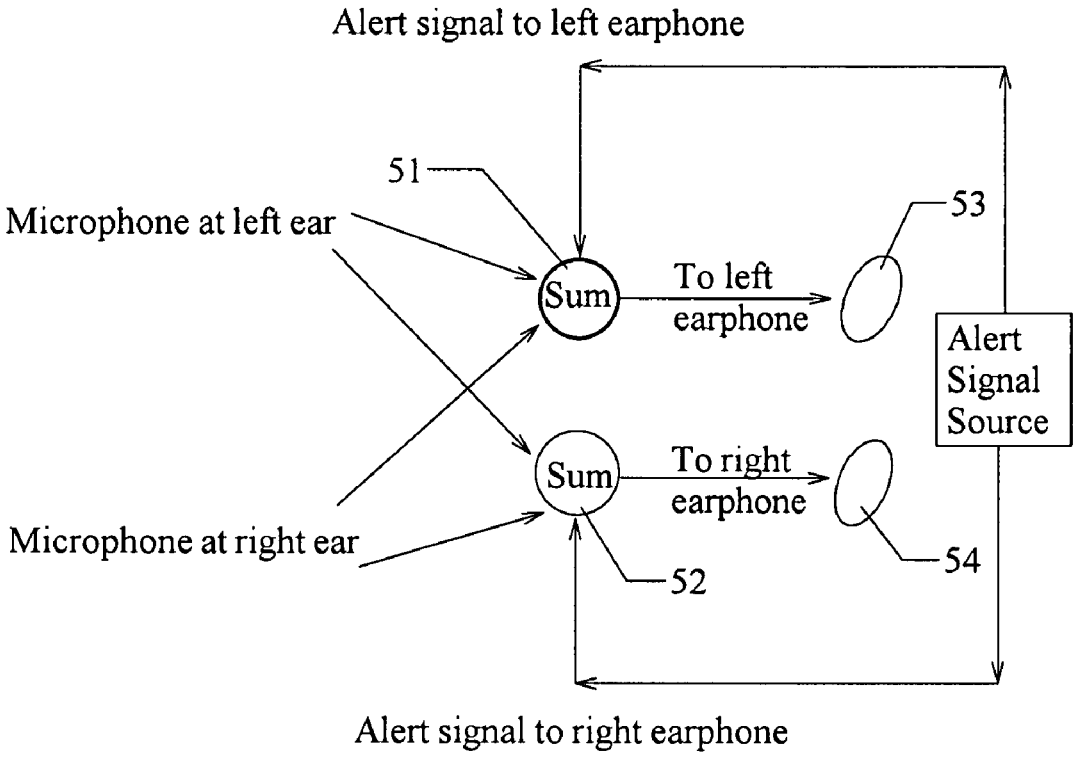
FIG. 7 schematically illustrates formation of the background signal and the differential binaural signal at the two stereo earphones in FIG. 6.

Each ear receives the same weighted average signal so that the subject perceives that a coherent source of the signal is somewhere near the "center" of the subject's head. This has been referred to as "inside-the-head localization" in the literature. The signal processor 57 also provides a differentiated binaural (alert) signal that is substantially different for each ear and represents a non-coherent source. Using this technique, the two ears can easily distinguish presence of a spatially modulated alert signal from the (uniform) background of the weighted average signal. Optionally, a differential binaural (alert) signal can be provided as in the first embodiment (frequencies in different critical bands at M dB above the background in each band), as in the second embodiment (differential time delay or differential intensity at the two stereo earphones, 53 and 54), or according to another approach that provides an alert signal that is distinguishable for at least one ear: FIG. 7 illustrates summing of the background signals and provision of a differentiated binaural signal at each earphone.

While the invention has been particularly shown and described, it is not to be limited in scope by the specific embodiments described herein. Indeed, various modifications of the invention in addition to those described herein will become apparent to those skilled in the art from the foregoing description and accompanying figures and drawings. Such modifications are intended to fall within the scope of the appended claims.

What is claimed is:

1. A method of distinguishing an auditory alert signal from a background of one or more other auditory signals, the method comprising:

providing a selected alert signal for a subject at a first apparent location that is initially angularly displaced relative to a selected axis by a selected first azimuthal angle $\phi\mathbf{1}$;

causing the first apparent location of the alert signal to change to a second apparent location that is angularly displaced relative to the selected axis by a selected second azimuthal angle $\phi\mathbf{2}$, where $|\phi\mathbf{1}-\phi\mathbf{2}|\geqq 15°$, within a selected time interval having a duration $\Delta t$ lying in a range $0.1\ \text{sec}\leqq\Delta t\leqq 0.5\ \text{sec}$; thereby permitting a subject to distinguish the change of the alert signal from the first apparent location to the second apparent location and to thereby distinguish the alert signal from at least one background signal having an apparent location that does not change.

2. The method of claim 1, further comprising allowing said apparent location of said alert signal to change to a third apparent location that is angularly displaced relative to said selected axis by a selected third azimuthal angle $\phi\mathbf{3}$ where $|\phi\mathbf{2}-\phi\mathbf{3}|\geqq 15°$, within a second selected time interval.

3. The method of claim 2, further comprising choosing at least one of said first azimuthal angle $\phi\mathbf{1}$, said second azimuthal angle $\phi\mathbf{2}$ and said third azimuthal angle $\phi\mathbf{3}$ so that at least one of the following constraints is satisfied: $|\phi\mathbf{1}-\phi\mathbf{2}|\geqq 30°$ and $|\phi\mathbf{2}-\phi\mathbf{3}|\geqq 30°$.

4. The method of claim 1, further comprising choosing at least one of said first angle $\phi\mathbf{1}$ and said second angle $\phi\mathbf{2}$ to lie in a combined azimuthal angle range given by $-120°\leqq\phi\leqq -15°$ plus $15°\leqq\phi\leqq 120°$.

5. The method of claim 1, further comprising causing said change from said first apparent location to said second apparent location to occur continuously in said selected time interval.

6. The method of claim 1, further comprising causing said change from said first apparent location to said second apparent location to include at least one discontinuous change within said selected time interval.

7. The method of claim 1, further comprising providing said alert signal through first and second earphones positioned adjacent to first and second ears, respectively, of said subject.

8. A system for distinguishing an auditory alert signal from a background of one or more other auditory signals, the system comprising:

an alert signal source that:

provides a selected alert signal for a subject at a first apparent location that is initially angularly displaced relative to a selected axis by a selected by a first azimuthal angle $\phi\mathbf{1}$: and causes the first apparent location of the alert signal to change to a second apparent location that is angularly displaced relative to the selected axis by a selected second azimuthal angle $\phi\mathbf{2}$, where $|\phi\mathbf{1}-\phi\mathbf{2}|\geqq 15°$, within a selected time interval having a duration $\Delta t$ lying in a range $0.1\ \text{sec}\leqq\Delta t\leqq 0.5\ \text{sec}$, thereby the subject to distinguish the change of the alert signal from the first apparent location to the second apparent location and thereby distinguish the alert signal from at least one background signal having an apparent location that does not change.

9. The system of claim 8, wherein said alert signal source:

allows said apparent location of said alert signal to change to a third apparent location that is angularly displaced relative to said selected axis by a selected third azimuthal angle $\phi\mathbf{3}$, where $|\phi\mathbf{2}-\phi\mathbf{3}|\geqq 15°$, within a second selected time interval having a duration $\Delta t$ lying in a range $0.1\ \text{sec}\leqq\Delta t\leqq 0.5\ \text{sec}$.

10. The system of claim 9, wherein at least one of said first azimuthal angle $\phi\mathbf{1}$, said second azimuthal angle $\phi\mathbf{2}$ and said third azimuthal angle $\phi\mathbf{3}$ is chosen so that at least one of the following constraints is satisfied $|\phi\mathbf{1}-\phi\mathbf{2}|\geqq 30°$ and $|\phi\mathbf{2}-\phi\mathbf{3}|\geqq 30°$.

11. The system of claim 8, wherein at least one of said first angle $\phi\mathbf{1}$ and said second angle $\phi\mathbf{2}$ is chosen to lie in a combined azimuthal angle range given by $-120°\leqq\phi\leqq -15°$ plus $15°\leqq\phi\leqq 120°$.

12. The system of claim 8, wherein said change from said first apparent location to said second apparent location occurs continuously in said selected time interval.

13. The system of claim 8, wherein said change from said first apparent location to said second apparent location includes at least one discontinuous change within said selected time interval.

14. The system of claim 8, wherein said alert signal is provided through first and second earphones positioned adjacent to first and second ears, respectively, of said subject.

* * * * *